US005161744A

United States Patent [19]

Schoop et al.

[11] Patent Number: 5,161,744

[45] Date of Patent: Nov. 10, 1992

[54] TRANSPORTABLE CRUSHER UNIT

[75] Inventors: Gunther-Dietmar Schoop, Ottmarsbocholot; Horst Maurer, Herten, both of Fed. Rep. of Germany

[73] Assignee: Klockner-Becorit, Castrop-Rauxel, Fed. Rep. of Germany

[21] Appl. No.: 667,573

[22] Filed: Mar. 11, 1991

[30] Foreign Application Priority Data

Mar. 12, 1990 [DE] Fed. Rep. of Germany ..... 4008176

[51] Int. Cl.[5] ..... B02C 21/02

[52] U.S. Cl. ..... 241/101.7

[58] Field of Search ..... 241/101.7

[56] References Cited

U.S. PATENT DOCUMENTS

| | | | |
|---|---|---|---|
| 3,000,649 | 9/1961 | Heer et al. . | |
| 4,881,691 | 11/1989 | Oldengott et al. | 241/101.5 |
| 4,951,885 | 8/1990 | Thüs | 241/101.7 |

FOREIGN PATENT DOCUMENTS

| | | | |
|---|---|---|---|
| 0252419 | 1/1988 | European Pat. Off. | 241/101.7 |
| 2941775A1 | 4/1981 | Fed. Rep. of Germany . | |
| 3615118 | 10/1987 | Fed. Rep. of Germany | 241/101.7 |
| 3627705 | 2/1988 | Fed. Rep. of Germany | 241/101.7 |
| 3819864 | 4/1989 | Fed. Rep. of Germany | 241/101.7 |
| 8900072.2 | 5/1989 | Fed. Rep. of Germany . | |
| 8901905.9 | 6/1989 | Fed. Rep. of Germany . | |
| 8814333.3 | 4/1990 | Fed. Rep. of Germany . | |
| 2072532A | 10/1981 | United Kingdom . | |

*Primary Examiner*—Mark Rosenbaum
*Assistant Examiner*—John M. Husar
*Attorney, Agent, or Firm*—Collard & Roe

[57] ABSTRACT

The invention relates to a crusher unit that can be transported directly on roadways, the crusher being mounted on an elongated, rigid frame which is supported by several travel mechanisms or support trestles which rest directly on the ground underneath. The frame has several hydraulic jacks which are adjustable in height and lift the travel mechanisms or support trestles from the ground when the jacks are extended. In order to reduce the height of this crusher unit during transportation, the invention proposes that the travel mechanisms or support trestles be removed for transportation. This is achieved by means of quick-release fastening mechanisms and by arranging and dimensioning the jacks such that there is sufficient room under the frame to drive a transport vehicle which can be used on roadways.

5 Claims, 4 Drawing Sheets

TRANSPORTABLE CRUSHER UNIT

BACKGROUND OF THE INVENTION

1. Field of the Invention

The invention relates to a crusher unit that can be transported directly on roadways. More particularly, it relates to such a unit in which the crusher is mounted on an elongated, rigid frame, which is supported by several travel mechanisms or support trestles which rest directly on the ground underneath. It especially relates to such a unit in which the frame has several lift jacks which are adjustable in height and lift the frame off the travel mechanisms or support trestles from the ground when extended.

2. The Prior Art

Crusher units are used to treat construction debris directly on site when roads are broken up or buildings are demolished. The crusher can produce reusable materials, e.g. granulates as an additive for concrete or bituminous road surfaces.

For road work, mobile crusher units are known which have frames that are equipped with a complete travel mechanism with wheels. These travel mechanisms can move the units on the construction site, as well as directly on roadways. These wheel mechanisms are very complicated and must be licensed for use on public roadways. However, such wheel mechanisms are not very well suited for construction sites with very uneven ground.

For uneven surfaces, mobile crusher units equipped with heavy caterpillar mechanism are generally used, according to the state of the art. However, such mobile crushers, which are also used in quarries or strip mining operations, have to be loaded onto suitable transport vehicles that can be driven on roadways, for example flat-bed trucks or roll-off trucks. This creates a problem in that the crusher unit with the caterpillar mechanism is relatively high, so that roadways with limited height allowances cannot be used.

Finally, according to the state of the art, so-called semi-mobile crusher units are also known. In these units the frame rests upon rigid support trestles, for example skid trestles while in use at the site. These crusher units are placed on a suitable transport vehicle for transport on roadways by means of a heavy crane.

With all the crusher units of the type discussed above, it is important to align the frame in a precisely horizontal position during operation of the crusher. Otherwise the heavy, rotating parts of the crusher unit will put undue stress on the bearings. For this reason, the known crusher units are equipped with adjustable lift jacks which lift the travel mechanisms or support trestles from the ground. This allows the frame to be horizontally aligned, even when the ground is uneven. Suitable wedges can be placed under the travel mechanisms or support trestles until the frame is in a precisely horizontal position.

SUMMARY OF THE INVENTION

It is therefore an object of the present to eliminate the aforementioned drawbacks and provide a unit which can easily be transported directly on roadways.

It is yet another object of the present invention to provide a unit that is easy to set up, take down, and prepare for transport.

It is a further object of the present invention to provide such a unit so that during transport on roadways it has a relatively low height.

These and other related objects are attained according to the invention by a crusher unit in which the travel mechanisms or support trestles are attached to the frame by means of quick-release fasteners. The frame is equipped with lift jacks which are dimensioned and arranged in such a way that when the frame is lifted and the travel mechanisms or support trestles are removed, there is room under the frame to drive a transport vehicle. The transport vehicle, for example, a roll-off truck, can then be used on roadways.

The crusher unit according to the invention has the advantage that it does not require a complicated travel mechanism which must be licensed. In addition, heavy loading cranes are not needed to lift the unit onto a transport vehicle. Finally, the unit presents a very low height during transport on roadways. This is because the caterpillar mechanisms or support trestles can be removed from the frame, once it has been lifted by the lift jacks. The transport vehicle, e.g. a roll-off truck, can then be driven in underneath the frame, into the space that has been cleared by removal of the caterpillar mechanisms or support trestles. The frame is then set down on this transport vehicle, by retracting the lift jacks. Since the frame rests directly on the transport vehicle, the height of the caterpillar mechanisms or support trestles is eliminated during transport.

In a particularly preferred embodiment of the invention, a front caterpillar mechanism is formed as a caterpillar dolly. The front end of the frame is connected via a removable tractor-trailer hitch to the caterpillar dolly.

In addition, two caterpillar mechanisms are formed as caterpillar supports for the rear of the frame. Each support is removably attached to one rear lateral longitudinal brace of the frame. This embodiment of the crusher unit has the advantage that it can be moved on the construction site even if the ground is very uneven.

In an especially preferred further embodiment of the invention, the caterpillar mechanisms can be interchanged with the rigid support trestles. In this manner, the rigid frame, the caterpillar mechanisms and the rigid support trestles form a type of modular system, which allows adaptation to the conditions on the construction site. In addition, this modular system has advantages with regard to manufacture, spare parts inventory and maintenance, because the individual modular components can be manufactured and serviced separately, and replaced individually.

Preferably, the quick-release fastening mechanisms have vertically positioned pegs which can be inserted into corresponding holder openings on the caterpillar mechanisms or support trestles from above and can be fixed in these holder openings by means of locking means. Insertion of the vertically positioned pegs into corresponding holder openings on the caterpillar mechanisms or support trestles is advantageous in that the lift jacks can be used for fastening and releasing the quick-release fastening mechanisms.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawing is designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
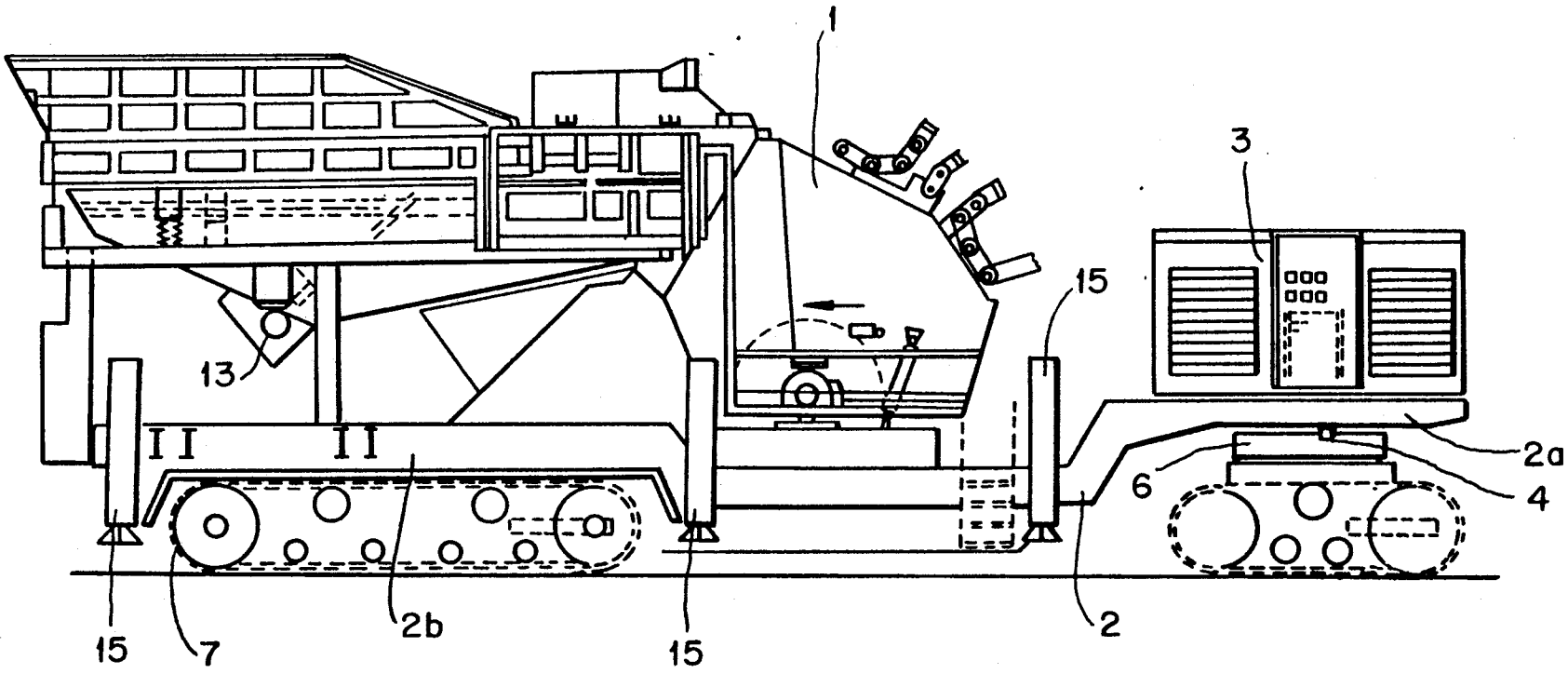
FIG. 1 is a side elevational view of a crusher unit embodying the present invention; in part phantom line and with portions broken away to show internal construction.
Figure 2:
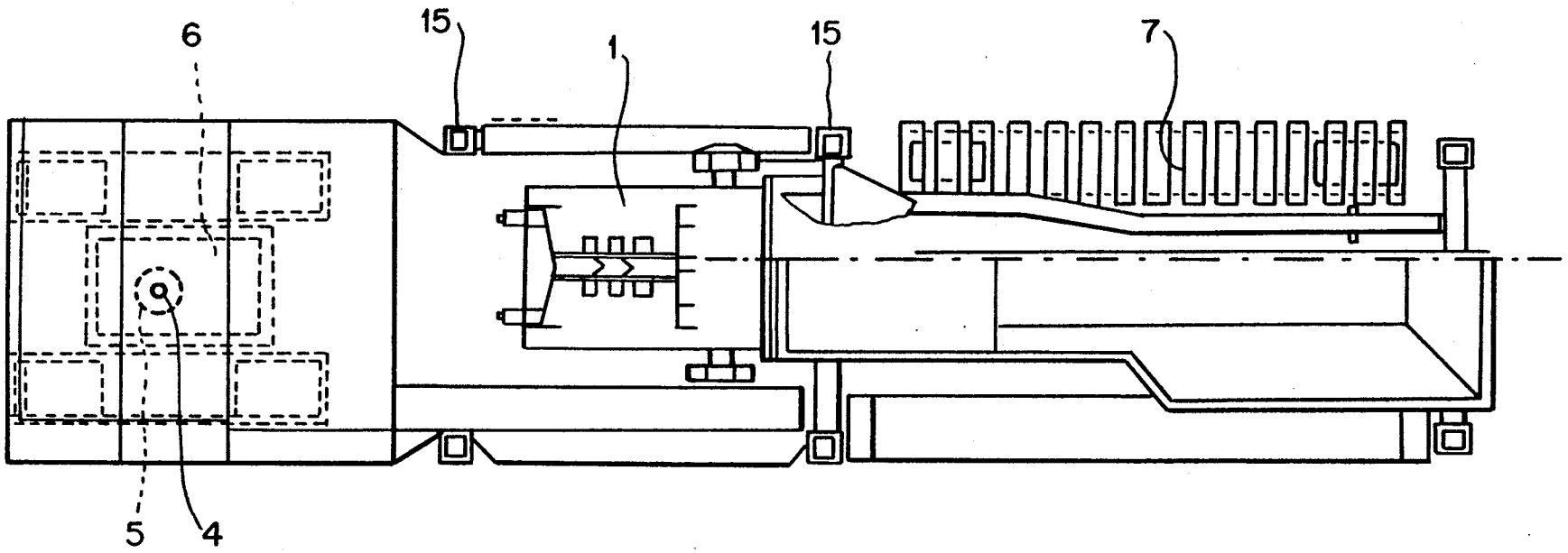
FIG. 2 is a plan view of the crusher unit in FIG. 1.

Referring now in detail to the drawings and, in particular, FIGS. 1 and 2 thereof, there is illustrated a crusher unit embodying the present invention, which includes a so-called "impact" crusher 1 mounted on an elongated, rectangular frame 2. Frame 2 has a right-angle bend directed downwards in the area of crusher 1. Since crusher 1 is extremely tall, the lowered platform in the area of crusher 1 helps maintain a low height profile for the unit. In its front area, frame 2 has a platform 2*a*, which carries a diesel-hydraulic drive assembly 3 for crusher 1 and, if applicable, for the travel mechanisms. Platform 2*a* is provided with a pivot peg 4, which can be inserted from above, into a corresponding holder opening 5 on the top of the chassis of a caterpillar dolly 6. Drive assembly 3 can also provide power for the caterpillar dolly 6. Pivot peg 4 and holder opening 5 together form a tractor-trailer hitch.

Figure 4:
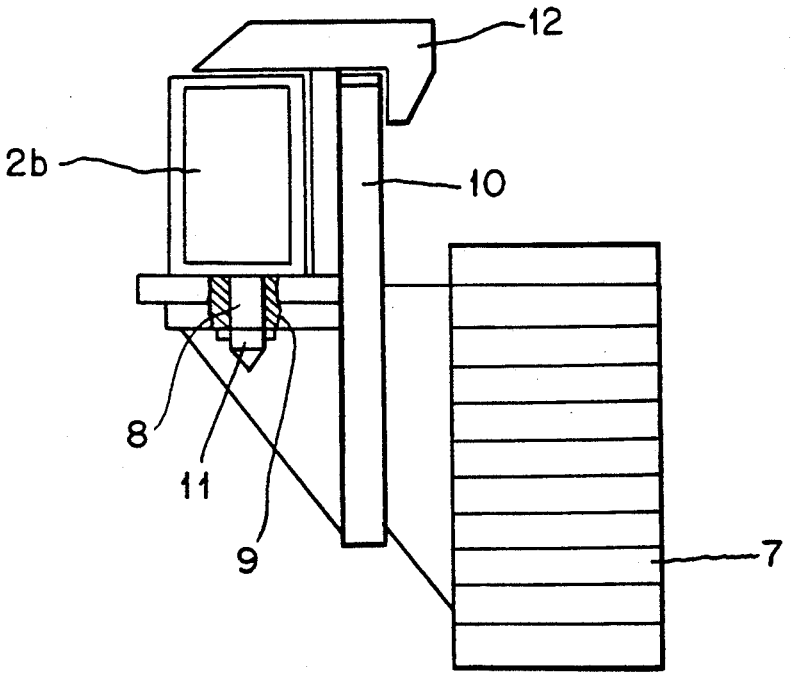
FIG. 4 is a cross-sectional view of one of the quick-release fastening mechanisms.

Furthermore, a pair of caterpillar mechanisms 7 are attached to the frame 2 adjacent to the lateral rear longitudinal braces 2*b* which are each formed as a caterpillar support. Optionally, caterpillar mechanisms 7 can also be equipped with hydraulic drives. The connection between the caterpillar mechanisms 7 and the longitudinal braces 2*b* (see FIG. 4) is achieved by vertically positioned pegs 8, and corresponding holder openings 9. Holder openings 9 are set within the longitudinal beams 10 of the caterpillar mechanisms 7. Pegs 8 are inserted from above and are fixed by a locking means 11. The transfer of force between frame 2, longitudinal braces 2*b* and the caterpillar mechanism 7 essentially takes place by means of hook-shaped projections 12 located on longitudinal braces 2*b*. Projections 12 rest on the longitudinal beams 10 of the caterpillar mechanisms 7 from above.

The rear part of frame 2 carries the conveyor means 13 necessary to charge crusher 1, as well as a conveyor means (of a known type not shown in greater detail) to transport the crushed material away. For this purpose, the conveyor means runs at an upward incline from the crusher output towards the end of the crusher unit.

The frame 2 is equipped with at least 3 lift jacks 15 which are adjustable in height and which are preferably driven hydraulically, but can also have other drive means. The vertical displacement of lift jacks 15 is dimensioned so that when lift jacks 15 are extended, caterpillar mechanisms 6 and 7 can be easily released and pulled or driven out from under the frame 2. Lift jacks 15 on the left and right sides are set at a width such that when caterpillar mechanisms 6 and 7 are removed, a suitable transport vehicle, for example a roll-off truck (not shown in the drawing), can easily be driven under frame 2. Frame 2 is then set on this transport vehicle by retracting lift jacks 15.

Figure 3:
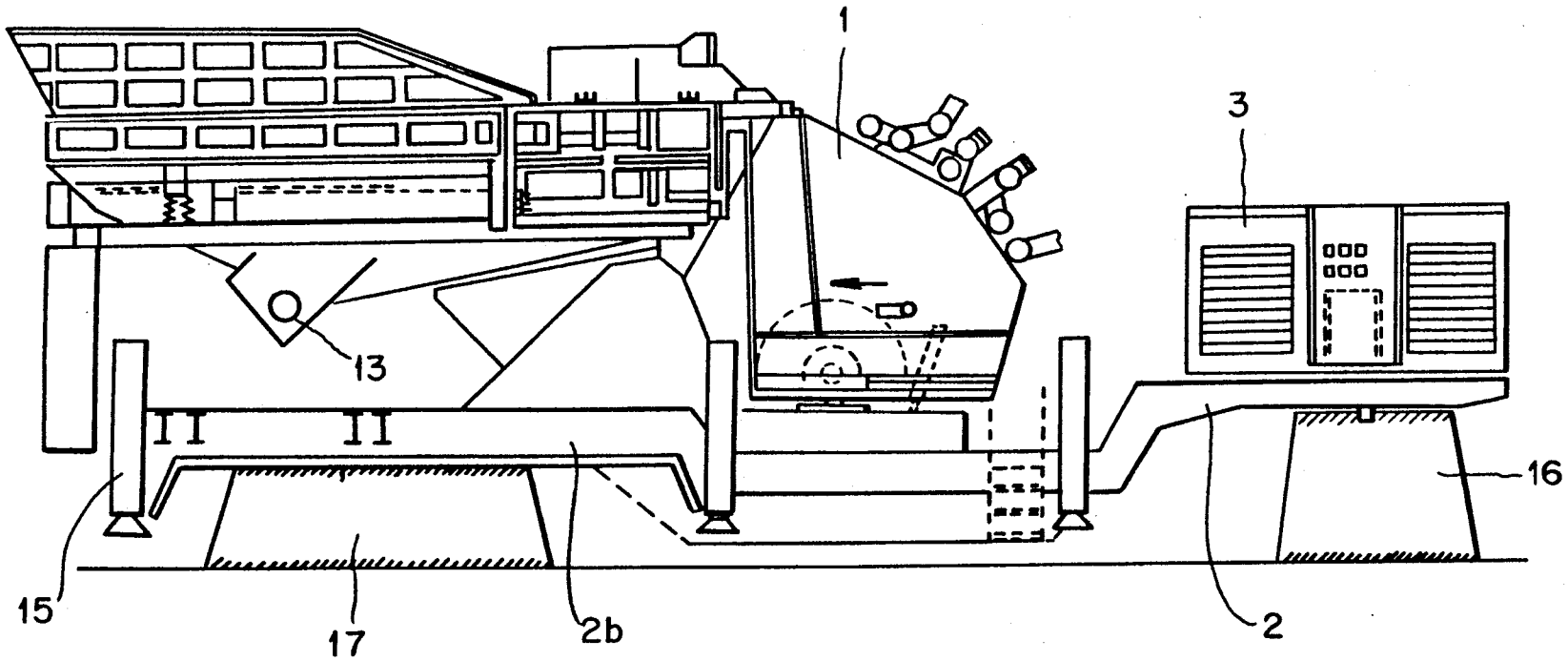
FIG. 3 is side elevational view of a crusher unit with support trestles according to a further embodiment of the invention.

In the embodiment shown in FIG. 3, support trestles 16 and 17, preferably in the form of skid trestles, are provided instead of the caterpillar mechanisms 6 and 7. The connection between the support trestles 16 and 17 and the frame 2 is brought about by means of similar quick-release fastening mechanisms. For example, pegs 4, 8 and the hook-shaped projections 12 on frame 2 correspond with holders on the support trestles 16 and 17. In this manner, the support trestles 16 and 17 can optionally be interchanged with the caterpillar mechanisms 6 and 7.

While only two embodiments of the present invention have been shown and described, it is to be understood that many changes and modifications may be made thereunto without departing from the spirit and scope of the invention.

What is claimed is:

1. A crusher unit movable by a transport vehicle on roadways comprising:

a crusher;

an elongated rigid frame on which said crusher is mounted, having a front end and a rear end, said front end including a tractor-trailer hitch and said rear end including two longitudinal brace members;

support means for supporting said frame above the ground, having a front caterpillar mechanism formed as a caterpillar dolly removable attached to said tractor-trailer hitch and two rear caterpillar mechanisms each removably attached to one of said longitudinal brace members, said caterpillar mechanisms providing movable support means;

quick-release fastening means for removably attaching said frame to said support means; and a plurality of hydraulic jacks attached to said frame for adjustably lifting said frame, said plurality of hydraulic jacks being dimensioned and positioned such that, upon removal of said support means, sufficient room is provided under said frame to drive a transport vehicle.

2. The crusher unit as claimed in claim 1, wherein said frame includes a lowered platform in the area of the crusher.

3. The crusher unit as claimed in claim 1, wherein said frame includes hook-shaped projections and said support means includes longitudinal beams for supporting said hook-shaped projections.

4. The crusher unit as claimed in claim 1, additionally including rigid, stationary support trestles, wherein upon removal of said support means, said support trestles are removably attachable to said front end of said frame and said longitudinal brace members.

5. The crusher unit as claimed in claim 1, wherein said fastening means comprises:

vertically positioned pegs located on said front end of said frame and said longitudinally brace members;

holder openings located on said support means for receiving said pegs therein; and locking means for releasably locking said pegs within said holder openings.

* * * * *